United States Patent [19]

Nakamura

[11] 4,358,838

[45] Nov. 9, 1982

[54] ELECTRONIC TIMEPIECE WITH A TIME STRIKING DEVICE

[75] Inventor: Norihiko Nakamura, Tokyo, Japan

[73] Assignee: Rhythm Watch Company Limited, Tokyo, Japan

[21] Appl. No.: 179,741

[22] Filed: Aug. 20, 1980

[30] Foreign Application Priority Data

Aug. 22, 1979 [JP] Japan ..... 54-106746

[51] Int. Cl.[3] ..... G04B 21/04; G04C 21/08

[52] U.S. Cl. ..... 368/75; 368/269; 368/273; 368/254; 368/270; 340/392

[58] Field of Search ..... 368/75, 71, 63, 245, 368/250, 251, 254, 257, 258, 261, 267, 269–271, 272–274; 340/384 R, 384 E, 392

[56] References Cited

U.S. PATENT DOCUMENTS

| | | | |
|---|---|---|---|
| 3,520,126 | 7/1970 | Kolodziej | 368/75 |
| 3,778,997 | 12/1973 | Jauch | 368/75 |
| 4,073,133 | 2/1978 | Earls et al. | 368/273 |
| 4,172,359 | 10/1979 | Gorsky et al. | 368/273 X |
| 4,247,933 | 1/1981 | Nakamura | 368/269 |
| 4,279,030 | 7/1981 | Masuzawa et al. | 368/75 X |

*Primary Examiner*—B. A. Reynolds
*Assistant Examiner*—Philip H. Leung
*Attorney, Agent, or Firm*—Koda and Androlia

[57] ABSTRACT

An electronic timepiece with a time striking device including an electric preliminary signalling means, an electric time striking means, an electric contact means, a time striking selecting means, and a time striking timing circuit in which a timer circuit is included, and preventing mishearing of time striking numbers at a right hour due to the preliminary signalling action making a time striking action predicted in advance.

3 Claims, 6 Drawing Figures

ELECTRONIC TIMEPIECE WITH A TIME STRIKING DEVICE

BACKGROUND OF INVENTION

1. Field of Invention

The present invention relates to an electronic timepiece with a time striking device, and more particularly to an electronic timepiece with a time striking device adapted to perform a preliminary signalling action prior to a time striking action at a right hour.

2. Description of Prior Art

Conventional time striking devices used with a timepiece are well-known in the art as a means for time striking or chiming at indicated times at such right hour that the minute hand points out 0 minutes and at such half hour that the minute hand points out 30 minutes, and it is of wide use in various clocks since a time is known without watching the time indicating hands. The time striking devices in the prior art, however, has such drawbacks that mishearing of first part of time striking numbers cannot provide correct time on account of time striking or chiming action performed at each striking time without any preliminary notice.

SUMMARY OF INVENTION

Accordingly, it is a general object of the present invention to provide an electronic timepiece with a time striking device adapted to perform a preliminary signalling action prior to a time striking action at a right hour.

In keeping with principles of the present invention the object is accomplished with an electronic timpiece with a time striking device which includes an electric preliminary signalling means, an electric time striking means, an electric contact means which electrically controls the operation of the above mentioned electric preliminary signalling means, a time striking selecting means synchronously rotating with the time indicating gear train to control the above mentioned electric contact means in a state capable of switching on action at a predetermined preliminary signalling time, and a time striking timing circuit operating the electric preliminary signalling means at the predetermined preliminary signalling time as well as operating the electric time striking means after the completion of preliminary signalling action.

According to the present invention, the preliminary signalling action for a certain time, 10 seconds for example, prior to the time striking action at a right hour can make the time striking action known in advance and prevent mishearing of time striking numbers at a right hour. The preliminary signal in the present invention can be composed of melody playing means, chiming means or the like.

BRIEF DESCRIPTION OF DRAWINGS

The above mentioned features and objects of the present invention will become more apparent by reference to the following description in conjunction with the accompanying drawings, wherein like reference numerals denote like elements, and in which.

DETAILED DESCRIPTION OF INVENTION

Figure 1:
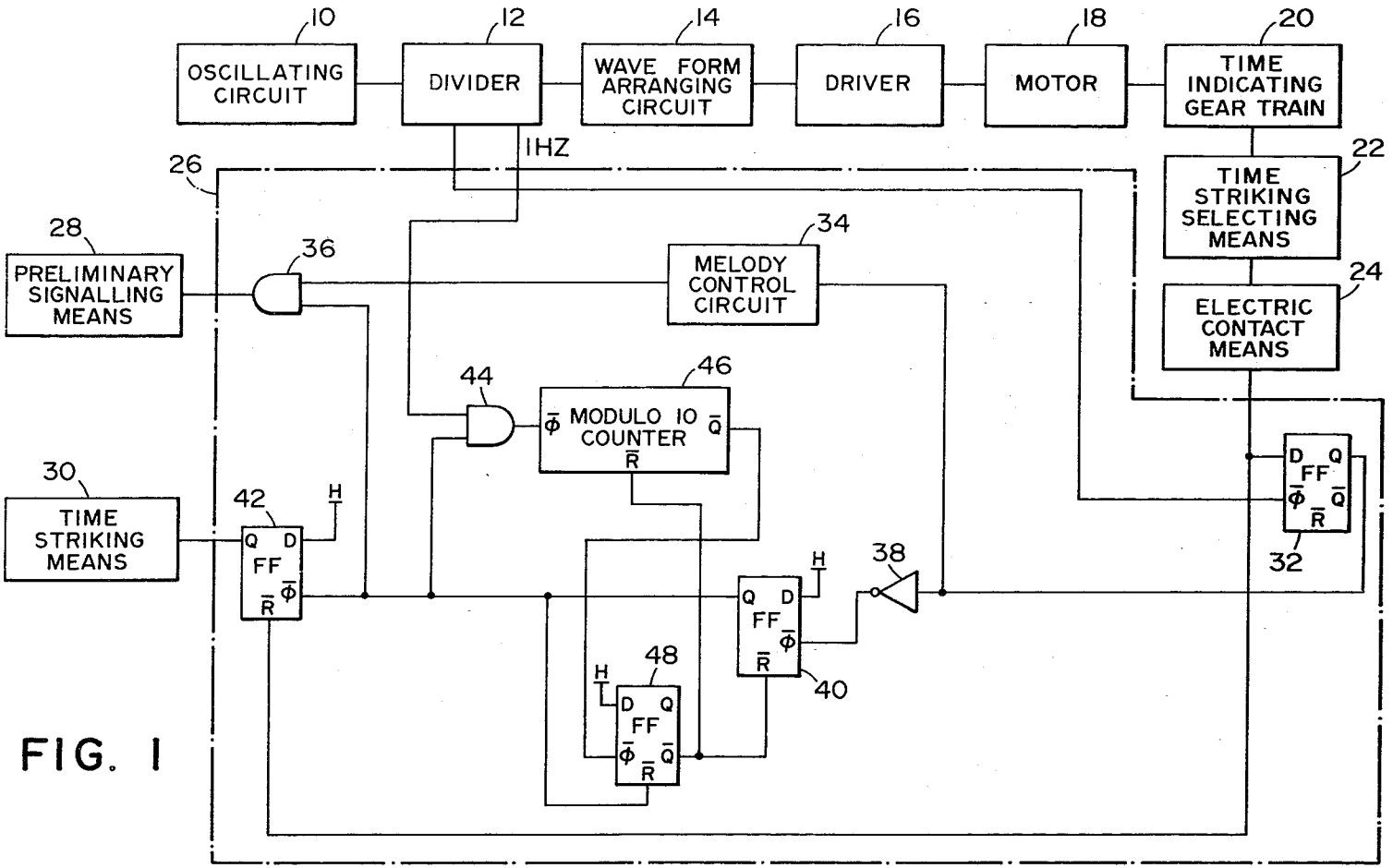
FIG. 1 is a block diagram showing a preferred embodiment of an electronic timepiece with a time striking device in accordance with the teachings of the present invention.

Referring more particularly to the drawings, shown in FIG. 1 is a block diagram showing a preferred embodiment of an electronic timepiece with a time striking device in accordance with the teachings of the present invention, and the electronic timepieces uses crystal oscillator. A high frequency signal from an oscillating circuit 10 including the crystal oscillator is divided by a divider 12 into pulse rows having desired frequencies so that the pulse rows are supplied to a driver 16 by way of a wave form arranging circuit 14. Driving pulses of the driver 16 is provided to a motor 18 composed of a step motor, synchronous motor or the like to rotate a rotor, and the rotation of the rotor is transmitted to a time indicating gear train 20 to obtain the constant rotation of time indicating hands.

According to the present invention, a time striking selecting means 22 is connected to the time indicating gear train 20, and the ON action of an electric contact means 24 is obtained at each right hour. The ON action of the electric contact means 24 provides a signal to an electric preliminary signalling means 28 by way of a time striking timing circuit 26 to perform preliminary signalling operation such as playing a melody right before a right hour. The time striking timing circuit 26 includes a timer circuit which moves a preliminary signalling means 28 for predetermined preliminary signalling time, 10 seconds for example, and provides a driving signal to an electric time striking means 30 to obtain the time striking action at right hour after completion of preliminary signal. The preliminary signalling means 28 consists of an electric preliminary signalling means which operates a sound system by a melody synthesized of electronic notes, and a time striking means 30 is formed with mechanical time striking system driven by the well-known motor.

The time striking timing circuit 26 is described in details in the following.

The ON action signal of the electric contact means 24 is supplied to D input of a flip-flop circuit 32, and the divided pulse rows of the divider 12 is supplied to the clock input of the flip-flop circuit 32. Q output of the flip-flop circuit 32 is supplied to a melody control circuit 34 and the output of synthesized electronic notes is supplied to an electronic sound converter of the preliminary signalling means 28 by way of a gate 36. Q output of the flip-flop circuit 32 is further supplied to the clock input of a flip-flop circuit 40, and Q output of the flip-flop circuit 40 is provided to the clock input of a flip-flop circuit 42. The flip-flop circuit 42 controls the operation of the time striking means 30 by the Q output supplied to the time striking means 30, and the OFF action signal of the electric contact means 24 is supplied to the reset input of the flip-flop circuit 42.

The Q output of the afore-mentioned flip-flop circuit 40 is further supplied to the input of the gates 36 and 44 to control the supply of the synthesized sound output from the melody control circuit 34 to the preliminary signalling means 28 as well as the count starting action of a modulo 10 counter 46 which composes of the timer circuit. The other input of the gate 44 receives a pulse row of 1 Hz. from the divider 12 and the modulo 10 counter has a timer count up time of 10 seconds. $\overline{Q}$ output of the modulo 10 counter 46 is supplied to the clock input of the flip-flop circuit 48 and $\overline{Q}$ output of the flip-flop circuit 48 is provided to the afore-mentioned flip-flop circuit 40 and the reset input of the modulo 10 counter 46. The reset input of the flip-flop 48 receives the Q output from the afore-mentioned flip-flop 40.

Figure 2:
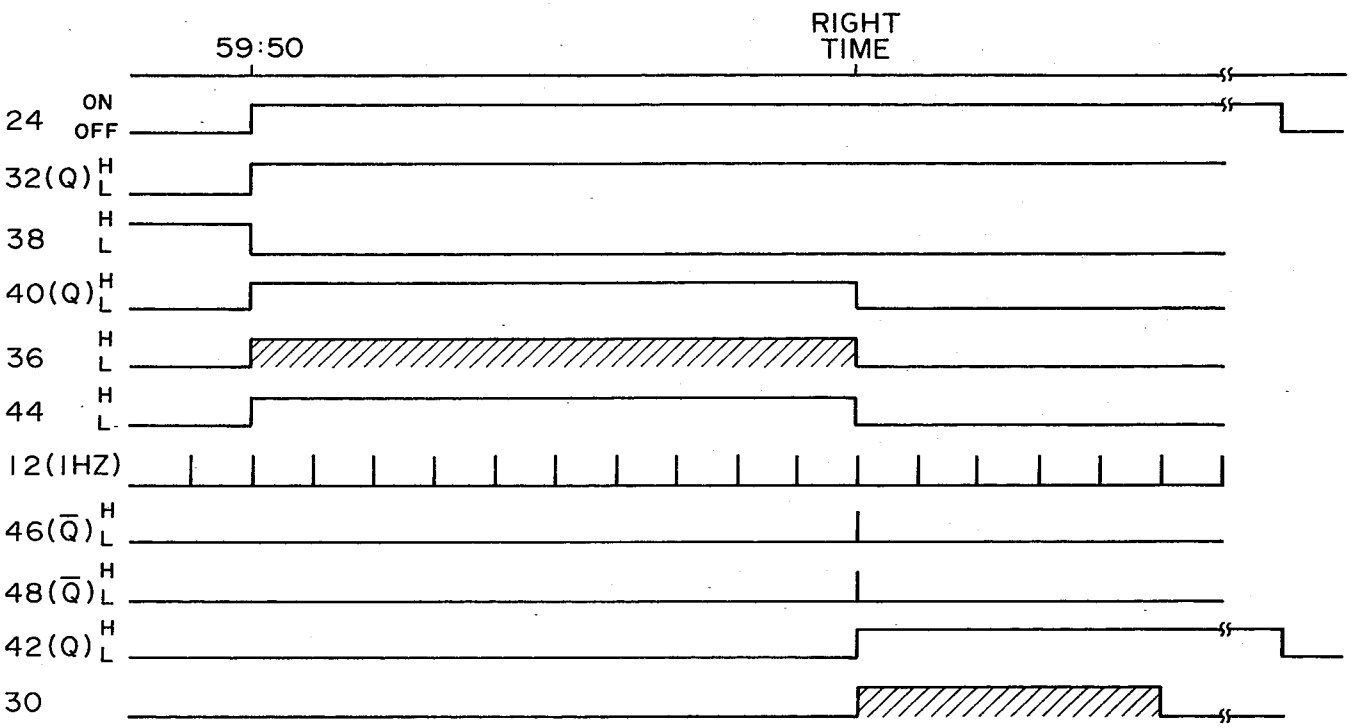
FIG. 2 is a wave form chart describing the action of FIG. 1.

In the embodiment illustrated in FIG. 1, the preliminary signalling action is performed at 10 seconds prior to a right hour. The electric contact means 24 is therefore put on at 59 minutes 50 seconds, and the ON signal is firstly supplied to the preliminary signalling means 28 by the time striking timing circuit 26 to perform 10 second preliminary signalling action so that the time striking action follows at a right hour. In FIG. 2 illustrated therein is the above mentioned operational conditions.

Referring to the action of the time striking timing circuit 26, the operation of the time striking device in the present invention is described in the following.

Every hour at 59 minutes 50 seconds the electric contact means 24 is put on, and the ON signal from the electric contact means 24 turns the Q output of the flip-flop circuit 32 into "H". Accordingly, the predetermined synthsized electronic note signals are supplied from the melody control circuit 34 to one input of the gate 36. The Q output of the flip-flop circuit 32 is further inverted by an inverter 38 to operate the flip-flop circuit 40 the Q output of the flip-flop circuit 40 is supplied to the other input of the gate 36. The synthesized electronic note signals of the melody control circuit 34 is provided from the gate 36 to the preliminary signalling means 28, and the preliminary signalling action by a playing melody is performed during the output period of the gate 36 shown in oblique lines in FIG. 2. At this time the Q output of the flip-flop circuit 42 is controlled by the Q output of the flip-flop circuit 40 so that the time striking action by the time striking means 30 is not performed.

The Q output of the flip-flop circuit 40 opens the gate 44, and the pulse row of 1 Hz. is supplied from the divider 12 to the modulo 10 counter 46. After 10 counted pulses $\overline{Q}$ output appears in the counter 46. The $\overline{Q}$ output of the flip-flop 48 resets the flip-flop circuit 40 and the modulo 10 counter 46. The counting time of the afore-mentioned modulo 10 counter 46 is determined at 10 seconds by 10 countings, and the Q output of the flip-flop circuit 40, therefore, becomes to appear at a right hour.

The reset of the flip-flop circuit 40 closes the gate 36 and the preliminary signalling action at the preliminary signalling means 28 is completed. The Q output of the flip-flop circuit 42 is supplied to the time striking means 30 at a right hour, and the rotation of time striking motor at the time striking means 30 provides the requested time striking action. The output of the time striking means 30 illustrated in the oblique lines in FIG. 2 shows the time striking period in which time striking or chiming with numbers is performed in correspondence with the right hour.

The electric contact means 24 is operated into OFF condition at an adequate time after the completion of the time striking action according as the mechanical rotation of the time striking selecting means 22, and the OFF action of the electric contact means 24 resets the flip-flop circuits 32 and 42 so that the time striking timing circuit returns to a time striking stand-by condition.

As described heretofore, the preliminary signalling action is obtained in the present invention prior to the time striking action at a right hour, but the accurate starting signals of the preliminary signalling action must be supplied from the electric contact means 24 to the time striking timing circuit 26 which determines various actions and preliminary signalling time. In FIGS. 3 through 6, shown therein are the preferred embodiments of the time striking selecting means 22 and the electric contact means 24 in order to obtain the accurate starting signals of the preliminary signalling action.

The electric contact means 24 in FIGS. 3 through 6 is equipped with moving contact plates **24*a* and 24*b*. In order to control the switching ON and OFF action of the electric contact means 24 is installed a time striking selecting cam plate 50 which synchronously rotate with a time indicating gear train, and a contact driving force of the time striking selecting cam plate 50 is transmitted to the above mentioned electric contact means 24 through a rocking piece 52. The time striking selecting cam plate 50 is fixed to the same pivot with a minute wheel, which is not illustrated, and rotates once an hour together with the minute wheel. On the time striking cam plate 50 are formed cam projections 54 corresponding to right hours so that the preliminary signalling action can be started. A leading edge 54*a* of the cam projection 54** is determined and placed so that the preliminary signal setting action, which is described later, can be performed about twenty seconds earlier than a right hour.

The rocking piece 52 is swingingly supported by a pivot 56 which is fixed to a supporting plate. A cam follower 58 formed in one portion of the rocking piece 52 swingingly engaged with the cam surface of the above mentioned time striking selecting cam plate 50, and pins 60 and 62 formed in the other portion of the rocking piece 52 are engaged with a rocking lever 64 in a rocking mechanism, which is described about hereinafter, and the above mentioned moving contact plate **24*b* respectively. The rocking piece 52 is installed to be always urged toward the direction of arrow A with elastic force so that the cam follower 58 is swingingly controlled to follow the cam surface of the time striking selecting cam plate 50, and is composed for the pins 60 and 62 to push and move the rocking lever 64 and the moving contact plate 24*b* when the cam projections 54 of the time striking selecting cam plate 50 and the cam follower 58** are engaged.

As mentioned in the above the switching ON and OFF operation of the electric contact means 24 is controlled at the determined preliminary signalling time with the synchronous rotation of the time indicating gear train. In order to obtain the time striking action corresponding to the predetermined striking time the rocking mechanism is installed in the time striking device. In the illustrated embodiment, the time striking action is controlled by the number of rotation of electro-motor, and the number of time striking is established corresponding to the striking time. The rocking lever 64 is swingingly held by the pivot 66 which is fixed to the supporting plate, and a stopper 68 formed in the one end of the rocking lever 64 is elongated to be selectingly engageable with rack teeth **70*a* of a rocking gear 70. The rocking lever 64 is always urged toward the direction of arrow B with elastic force by a spring 72, and a circular arc shaped pressing section 74 is formed to be engageable with the moving contact plate 24*a***.

The rocking gear 70 is swingingly held by a pivot 76 which is fixed to the supporting plate, and always urged toward the direction of arrow C with elastic force by the spring 72. The rocking gear 70 selects the number of rotation of the electro-motor or the number of time striking depending on the swung position of the rack teeth 70*a*, which is controlled by a rocking cam plate 78.

The rocking cam plate 78 is solidly molded with an hour hand wheel, which is not illustrated, and is formed with twelve step cam surface 78*a* on its outside circumference corresponding to each one hour of twelve hour display by a time indicating hand. The above mentioned rocking gear 70 has a cam follower 70*b* which is selectingly engageable with the cam surface 78*a* of the rocking cam plate 78.

A driving cam 82 is fixed to a shaft 80 of a driving motor which is not illustrated, and a driving pin 84 attached to the driving cam 82 is composed to be geared with the rack teeth 70*a* of the rocking gear 70 and to release the engagement between the stopper 68 of the rocking lever 64 and the rack teeth 70*a* of the rocking gear 70 at every rotation of the electro-motor to drive and move the rack teeth 70*a* one tooth by one tooth.

As described heretofore, at the predetermined preliminary signalling time the time striking selecting cam plate 50 controls the electric contact means 24 in a state capable of switching ON action through the rocking piece 52, and the time striking action is performed with the number of time striking selected through the rocking mechanism. The time striking selecting cam plate 50 rotates once an hour, and the time striking action cannot be obtain with high accuracy due to the rotation made in slow speed. In the present embodiment, however, the switching ON action of the electric contact means 24 is controlled by a time striking control cam plate installed separately from the time striking selecting cam plate 50.

A one minute cam plate 86 is solidly molded with a third wheel which is not illustrated in order to synchronously rotate with the time indicating gear train, and is formed with eight cam projections 88 around the circumference. Each of cam projections 88 is composed to rotate one pitch per minute.

In the illustrated embodiment, a cam driving force of the one minute cam plate 86 is transmitted to the electric contact means 24 by way of a switching control lever 90, which is swingingly held by a pin 92 fixed to the supporting plate. An engaging portion 94 formed in the one end of the switching control lever 90 is equipped to be capable of engaging with the cam projection 88, and a contact holder 96 formed in the other end is equipped to be capable of selectingly engaging with the moving contact plate 24*b* of the electric contact means 24. The switching control lever 90 is always urged toward the direction of arrow D with elastic force by a spring 102 placed between a pin 98 which is installed on the lever 90 and a fixing pin 100, and elastically sustained in the position to be engaged with a pin 104 fixed to the supporting plate.

Figure 3:
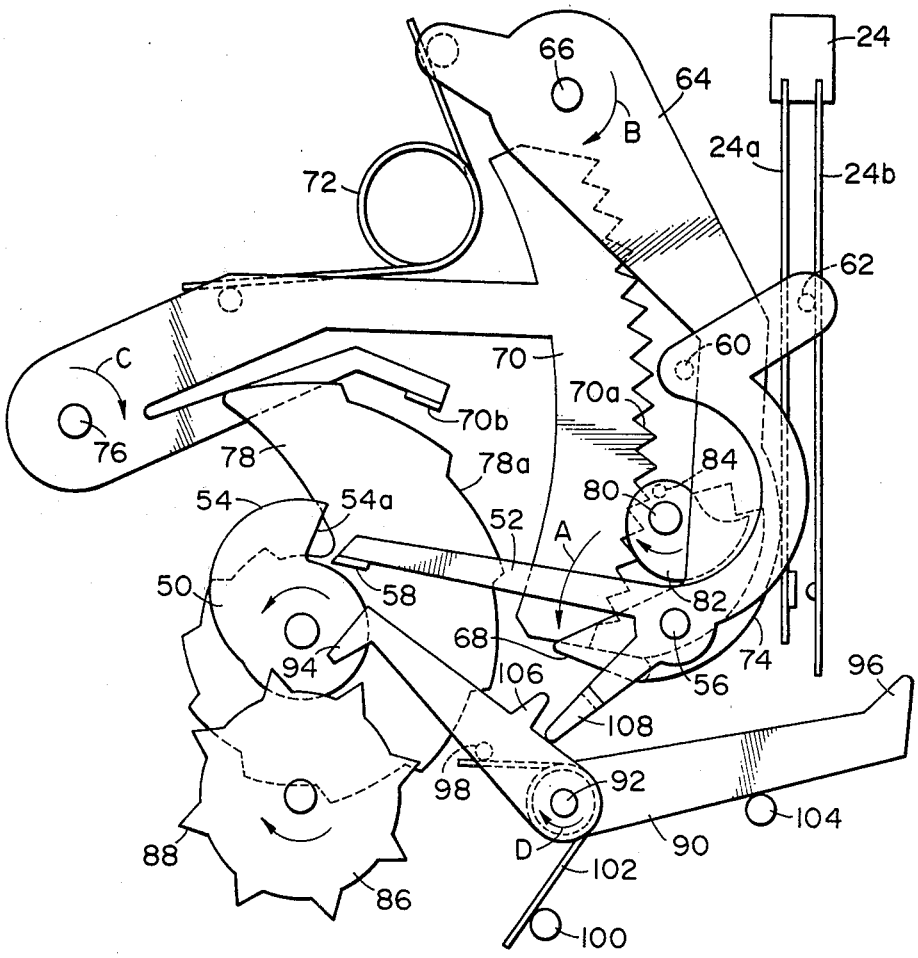
FIGS. 3 through 6 are top views showing the respective operating conditions in a preferred embodiment of a time striking selecting means and electric contact means.

As evident from FIG. 3, it is understood that, in the state that the one minute control lever 90 is engaged with the pin 104, the engaging portion 94 stays out of the rotation area of the one minute cam plate 86. A projection arm 106 is formed with the one minute control lever 90, and an extended arm 108 of the rocking piece 52 is engageably formed to face the projection arm 106.

The preferred time striking selecting mechanism 22 and electric contact means 24 of the present invention is composed as mentioned in the above, and the operation of the time striking selecting mechanism 22 and the electric contact means 24 of the present invention is described in the following, referring to FIGS. 4, 5 and 6 which show their various stages.

In FIG. 3, shown therein is a completed operating state of the time striking action at a right hour, for example, it corresponds to the time about 2:05. In this state, the cam follower 58 of the rocking piece 52 faces to the alcove portion of the time striking selecting cam plate 50, and the stopper 68 of the rocking lever 64 stays in the illustrated position to be engaged with the left end portion of the rack teeth 70*a* of the rocking gear 70. The both moving contact plates 24*a* and 24*b* are sustained in the position by the respective pressing section 74 of the rocking lever 64 and the pin 62 of the rocking piece 52, and the electric contact means 24 is in the open circuit state. The time striking means is kept in non-operational state accordingly.

In FIG. 3, as mentioned in the above, the engaging portion 94 stays out of the rotating area of the one minute cam plate 86 since the switching control lever 90 is urged by the spring 102 to the engaging portion with the pin 104. Consequently, in the ordinary cases excluding the striking time, the one minute cam plate 86 simply run idle and there is no load produced to the time indicating gear train by the switching control lever 90.

Figure 4:
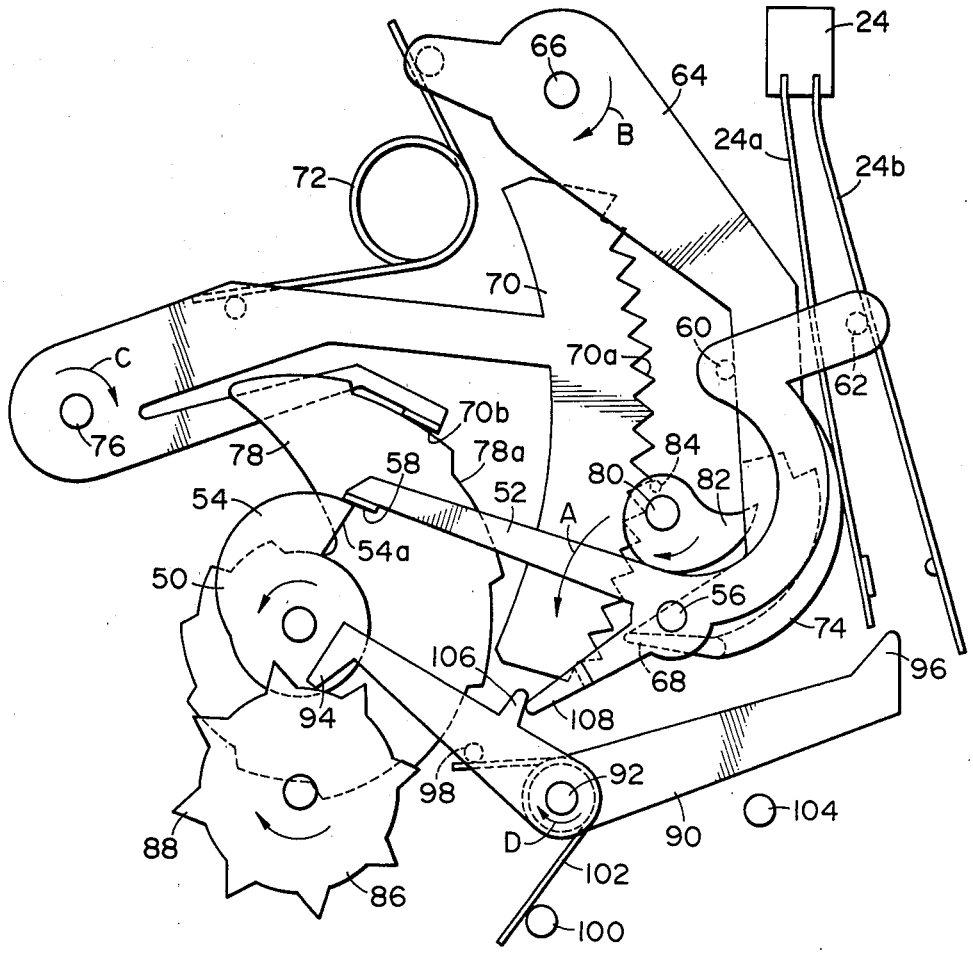

In FIG. 4, shown therein is a completed state of setting the first stage of the preliminary signalling action just before a right hour, a state of the time about 1:59:20. In this state, the rocking piece 52 is rotated clockwise by the cam projection 54 of the time striking cam plate 50, and the rocking lever 64 is rotated counter-clockwise to move to the position where the stopper 68 can be released from the rocking gear 70. Consequently, the rocking gear 70 rotates clockwise to the position where the cam follower 70*b* makes contact with the cam surface 78*a* of the rocking cam plate 78 corresponding to 2 o'clock. In this state, the both moving contact plates 24*a* and 24*b* of the electric contact means 24 are respectively pressed to move to the illustrated position by the pressing section 74 of the rocking lever 64 and the pin 62 of the rocking piece 52, and the electric contact means 24 is still kept in the open circuit state.

Furthermore, the rocking piece 52 presses to rotate the projection arm 106 of the switching control lever 90 by its extended arm 108 so that the switching control lever 90 rotates counter-clockwise against the force of the spring 102, and the engaging portion 94 falls into the rotating area of the one minute cam plate 86. The action of the contact holder 96 at this time is established in the various composition so that the contact holder 96 cannot collide with the moving contact plate 24*b*.

Figure 5:
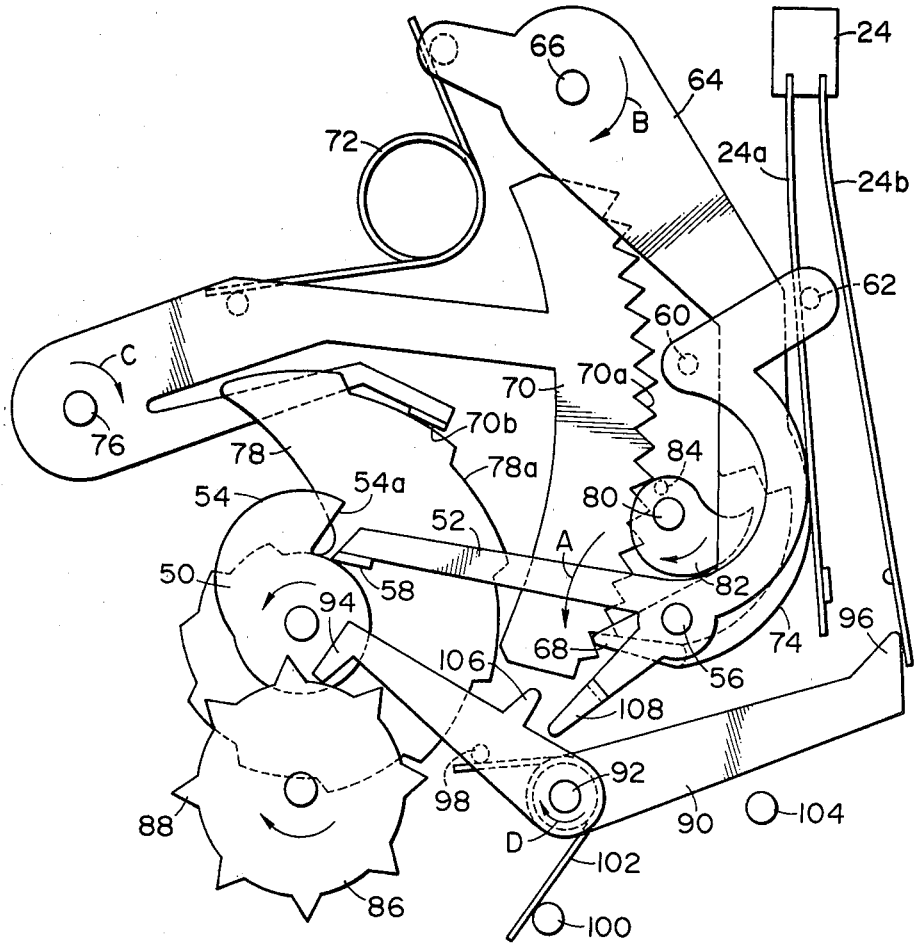

In FIG. 5, shown therein is a completed state of setting the second stage of the preliminary signalling action at a right hour, which corresponds to the time of 1:59:40. In this state, the rocking piece 52 moves to fall into the leading edge of 54*a* of the cam projection 54 by the rotation of the time striking selecting cam plate 50, and rotates counter-clockwise to release the pressure of the rocking lever 64 by the pin 60. Consequently, the rocking lever 64 rotates clockwise, and the stopper 68 is engages with the tooth corresponding to 2 o'clock among the rack teeth 70*a* of the rocking gear 70. At the same time, the pressing section 74 of the rocking lever 64 and the pin 62 of the rocking piece 52 release the pressed sustention of the both moving contact plates 24*a* and 24*b*. Accordingly, the moving contact plate 24*a* moves clockwise from the position shown in FIG. 4, however, the moving contact plate 24*b* is engaged with the contact holder 96 of the switching control lever 90 to be kept in the position shown in FIG. 5. Therefore, the switching ON action of the electric contact means 24 is not performed in FIG. 5.

In the operation mentioned in the above, the counterclockwise rotation of the rocking piece 52 also releases the engagement between the extended arm 108 and the projection arm 106, and the clockwise rotating force by the spring 102 activates the switching control lever 90. The switching control lever 90 is, however, kept in the position shown in FIG. 5 by the moving contact plate 24*b* since the rotating force by the moving contact plate 24*b* is established in equilibrium with the rotating force by the spring 102.

Figure 6:
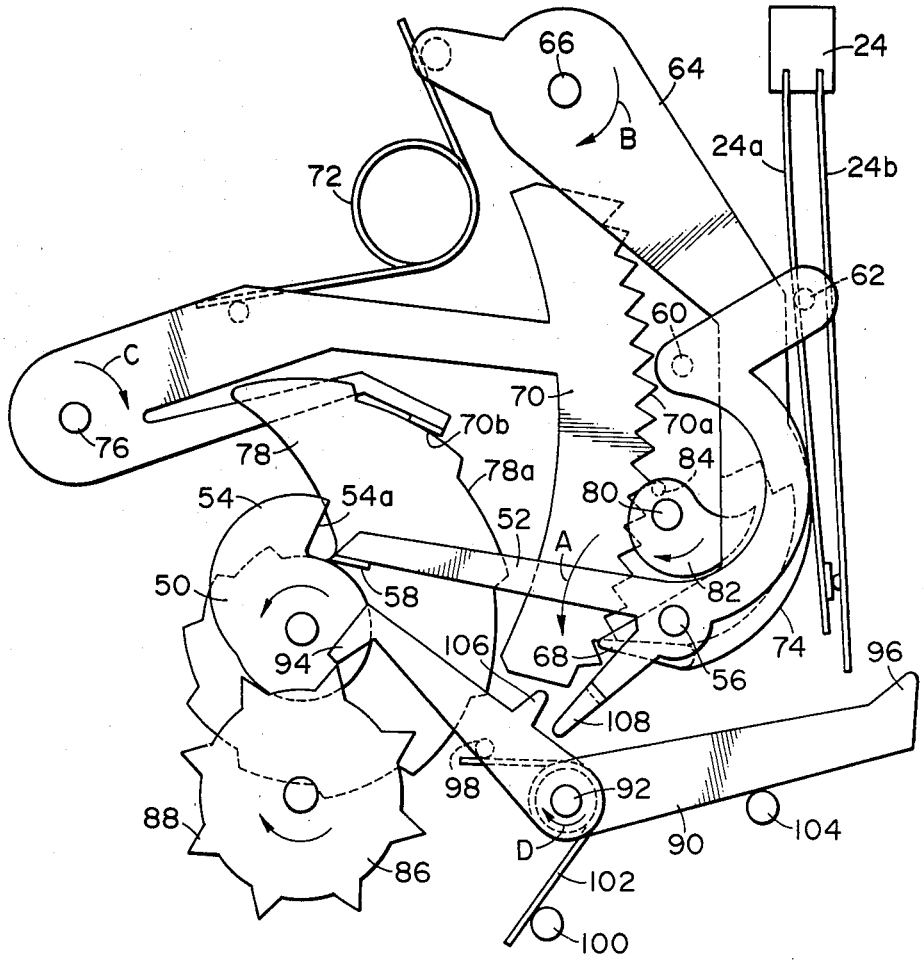

Referring to FIG. 6, shown therein is a state starting the preliminary signalling action just before the right hour, corresponding to the time of 1:59:50. In this state, the cam projection 88 of one minute cam plate 86 synchronously established at the controlled position of the second hand makes contact with the engaging portion 94 of the switching control lever 90, and moves the switching control lever 90 clockwise. Consequently, the contact holder 96 of the switching control lever 90 is released from the moving contact plate 24*b*, which returns to the contacting position with the moving contact plate 24*a* by its resilient property, and the switching ON action of the electric contact means 24 is obtained.

The switching ON action of the electric contact means 24 provides the preliminary signalling action by the above mentioned time striking timing circuit 26 and the time striking action follows the the preliminary signalling. In the time striking action, the driving motor in the electric time striking means rotates to perform the time striking action. At this time, the rotation of the driving cam 82 linked with the rotation of the electromotor drives to move the rack teeth 70*a* of the rocking gear 70 once every striking action. Accordingly, after the completion of two time striking actions, the stopper 68 of the rocking lever 64 is released from the rocking gear 70 to return to a state shown in FIG. 5, which opens the both moving contact plates 24*a* and 24*b*. The time striking action is performed at every striking time with the numbers determined by the position of the rocking cam plate 78 corresponding to the indicated time.

As mentioned in the above, the embodiment of the present invention can provide the time striking action with extremely high accuracy since the electric contact means 24 is controlled in a state capable of the switching ON action by the one minute cam plate 86. Accordingly, the preliminary signalling action can be performed at least within the range between 50 seconds and the right hour of the second indicating hand, and the time striking action can be performed at least within the range of 10 seconds from the right hour of the second indicating hand.

As described heretofore, the preliminary signalling action of playing melody, etc. can be provided prior to the time striking action performed at the right hour, and prediction of the striking action in advance can firmly prevent mishearing of the time striking numbers.

What is claimed is:

1. An electronic timepiece with a time striking device comprising:

an electric preliminary signalling means;

an electric time striking means;

an electric contact means electrically controlling the operation of said electric preliminary signalling means, said contact means comprising at least first and second moving contact plates;

a time striking selecting means synchronously rotating with a time indicating gear train to control said electric contact means in a state capable of switching ON action at a predetermined preliminary signalling time, said selecting means comprising:

a time striking selecting cam plate which rotates once each hour;

a cam projection provided on said time striking selecting cam plate at a position corresponding to a predetermined preliminary time before an hour position;

a rocking cam plate which rotates once each twelve hours;

at least twelve step cam surfaces provided on said rocking cam plate, said step cam surfaces being arranged and configured such that a radius of said rocking cam plate increases from a first step cam surface to a twelfth step cam surface;

a one minute cam plate rotating in synchronism with a time indicating gear train;

at least eight cam projections provided on said one minute cam plate, said cam projections rotating one pitch per minute;

a rocking gear of generally T-shape and rotatable about an end of a stem of said T-shape;

a plurality of rack teeth provided on a cross bar of said T-shaped rocking gear;

a cam follower provided on said rocking gear which is biased into engagement with said step cam surfaces;

an elongated rocking lever which is rotatable about one end and having another end for engagement with said rack teeth, said elongated rocking lever further engaging with said first moving contact plate and for moving said first moving contact plate towards said second moving contact plate when said another end is engagement with said rack teeth;

a rocking piece provided with a cam follower which is biased into engagement with said time striking selecting cam plate, said rocking piece for moving said second moving plate away from said first moving plate when said cam follower engages with said cam projection on said time striking selecting cam plate;

an elongated one minute control lever rotatable about a point between a two ends of said lever, one end of said lever for engagement with said cam projections of said one minute cam plate, said lever being biased such that said end is disengaged from said cam projections, another end of said one minute control lever for engagement with said second moving contact plate when said one minute control lever is rotated such that said end engages with said cam projections;

a projecting arm provided on said one minute control lever;

an extended arm provided on said rocking piece which is engageable with said projecting arm for rotating said end of said one minute control lever into engagement with said cam projections; and a rotating cam drive for moving said rack teeth one tooth each time said rotating cam drive rotates one rotation; and a time striking circuit for controlling the operation of said electric preliminary signalling means at said predetermined preliminary signalling time and for activating said electric time striking means after completion of said operation of said electric preliminary signalling means.

2. An electronic timepiece with a time striking device according to claim 1 wherein said time striking timing circuit includes a timer circuit which determines the preliminary signalling time.

3. An electronic timepiece according to claim 2, wherein said predetermined preliminary time is substantially 20 seconds before the hour.

* * * * *